United States Patent [19]

Blake, deceased

[11] 4,017,314

[45] Apr. 12, 1977

[54] USE OF CROWN COMPOUNDS (CYCLIC POLYETHERS) IN LITHO DEVELOPERS TO IMPROVE HALFTONE DOT QUALITY AND GRADATION

[75] Inventor: Ralph Kingsley Blake, deceased, late of Union County, N.J., by June Arlene Blake, executrix

[73] Assignee: E. I. Du Pont de Nemours and Company, Wilmington, Del.

[22] Filed: Jan. 7, 1976

[21] Appl. No.: 647,642

[52] U.S. Cl. ..... 96/66 R

[51] Int. Cl.[2] ..... G03C 5/30

[58] Field of Search ..... 96/66 R, 663, 107

[56] References Cited

UNITED STATES PATENTS

| | | | |
|---|---|---|---|
| 2,477,323 | .7/1949 | Wood | 96/66.3 |
| 3,062,646 | 11/1962 | Dann et al. | 96/66.3 |
| 3,749,574 | 7/1973 | Pollet et al. | 96/66.3 |

*Primary Examiner*—Mary F. Kelley

[57] ABSTRACT

A photographic developer for high contrast lithographic films comprising a conventional hydroquinone formaldehyde bisulfite developer and a crown compound (cyclic polyether) e.g. dibenzo-30-crown-10.

10 Claims, No Drawings

USE OF CROWN COMPOUNDS (CYCLIC POLYETHERS) IN LITHO DEVELOPERS TO IMPROVE HALFTONE DOT QUALITY AND GRADATION

BACKGROUND OF THE INVENTION

Various developer additives are known and employed in the field of photographic processing to produce clearly defined, high contrast images exhibiting improved halftone dot quality. The practice is particularly well known in the graphic arts industry.

Dot quality is characterized by halftone dots having high density and well defined image sharpness. In determining dot quality the processed samples are evaluated through microscopic observations and rated subjectively on a numerical scale from 1 to 4 of diminishing quality wherein 1.0 is excellent and 4.0 is unacceptably poor.

In order to produce the desired halftone dot quality and good gradient for sharp image formation, it is necessary that a suitable developer be used with an appropriate photosensitive material. Many modifications of the developer compositions have been made for these purposes. For example, linear polyethylene glycols have been added to developers to reduce the induction period. Also it is known to use linear polyalkylene glycols or alkylene oxide polymers in a hydroquinone or substituted hydroquinone developer having low ionized sulfite to produce good dot quality and increased gradient.

It has now been found that cyclic polyethers or crown compounds are more effective for increasing gradient and improving dot quality in lithographic films than the linear polyethers. Films processed in these developer compositions give excellent dot quality at optimum development times, as well as latitude in terms of gradient.

SUMMARY OF THE INVENTION

An aqueous hydroquinone or substituted hydroquinone developer comprising, per liter of working strength solution, 1.0 to 100 milligrams of at least one crown compound having 5 to 16 oxygen atoms in a cyclic ring having a total of 14 to 60 atoms (cyclic polyether). When the crown compound is admixed with various conventional lithographic developers it renders the developers more efficient in terms of improved dot quality and increased gradient, especially in deep tank and machine processing.

DETAILED DESCRIPTION OF THE INVENTION

The developers which are employed in accordance with this invention are members of the lithographic developer family. More specifically they are of the hydroquinone or substituted hydroquinone classes having a high pH, and they contain certain crown compounds, i.e. cyclic polyethers containing from 5 to 16 ether oxygen atoms in the cyclic ring. These are added to improve film characteristics such as dot quality and gradients, i.e. contrast. In general the crown compounds are added in amounts of from 1.0 to 100 milligrams and preferably from 5.0 to 20 milligrams per liter of working strength developer solution. When present in a lithographic developer, crown compounds are effective in increasing contrast (gradient), and improving halftone dot quality, whether in tray processing, deep tank processing or continuous transport machine processing.

The term "crown" compounds as applied to the cyclic ethers of this invention is intended to simplify their cumbersome chemical names. Further explanation of this nomenclature and methods of preparation can be found in a paper entitled: Cyclic Polyethers and Their Complexes with Metal Salts, C. J. Pedersen, Journal of the American Chemical Society (89:26) Dec. 20, 1967. The trivial names consist of in order: (1) the number and kind of hydrocarbon rings, (2) the total number of atoms in the polyether ring, (3) the class name, "crown", and (4) the number of oxygen atoms in the polyether ring. These cyclic ethers are preferably as symmetrical as possible. The total number of atoms in the ring may range from 14 to 60 but the preferred compounds contain between 18 and 30 atoms in the ring. The number of ether oxygen atoms may be from 5 to 16 but preferably the compounds contain from 6 to 10 oxygen atoms. Compounds useful in the invention are illustrated below:

Compound I

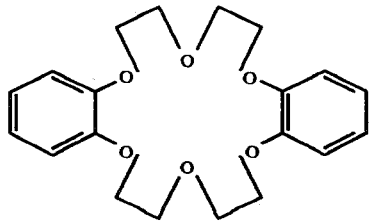

dibenzo-18-crown-6

Compound II

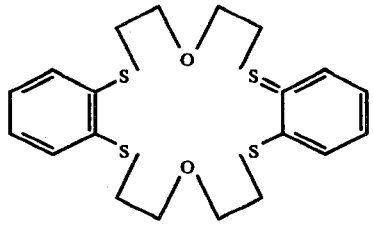

1,4,10,13-tetra-thia-dibenzo-18-crown-6

-continued

Compound III

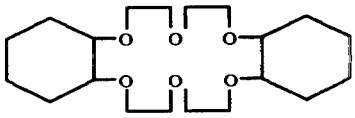

dicyclohexane-18 crown 6

Compound IV

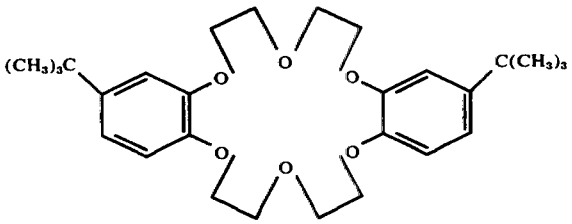

bis(t-butylbenzo)-18-crown-6

Compound V

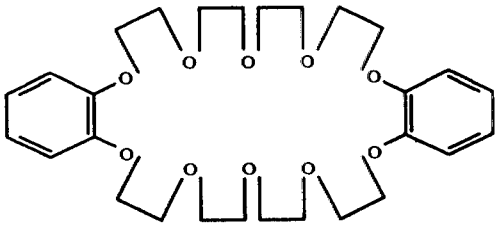

dibenzo-30-crown-10

As indicated by Compound II above, useful cyclic compounds may have some of the oxygen atoms replaced by sulfur atoms.

Other suitable compounds are those disclosed in the above-mentioned paper by C. J. Pedersen, the disclosure of which is incorporated by reference. These compounds are as follows:

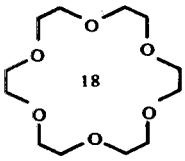

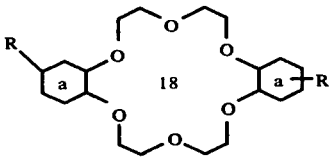

a = BENZO R = H
a = 2,3-NAPHTHO
a = CYCLOHEXYL R = 1-BUTYL

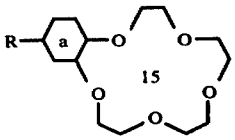

a = BENZO R = H
a = BENZO R = 1-BUTYL
a = 2,3-NAPHTHO
a = CYCLOHEXYL
R = H
a = CYCLOHEXYL
R = 1-BUTYL
a = 2,3-DECALYL

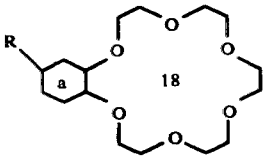

a = BENZO R = H
a = BENZO R = 1-BUTYL
a = 2,3-NAPHTHO
a = CYCLOHEXYL R = H
a = CYCLOHEXYL
R = 1-BUTYL

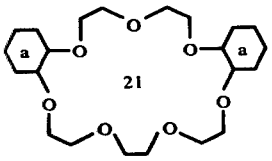

a = BENZO
a = CYCLOHEXYL

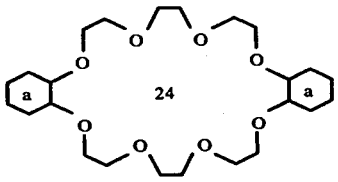

a = BENZO
a = CYCLOHEXYL
a = 2,3-NAPHTHO

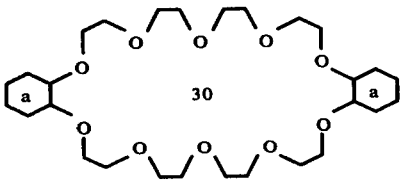

a = CYCLOHEXYL

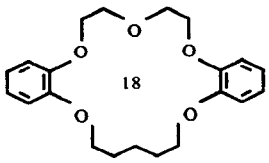

-continued

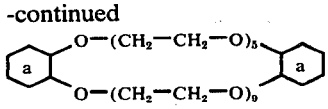

a = BENZO
a = CYCLOHEXYL

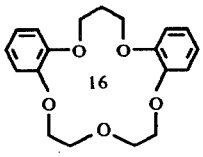

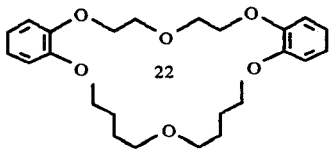

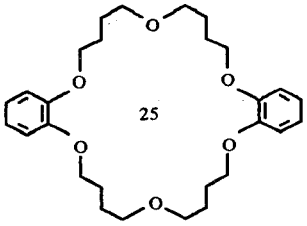

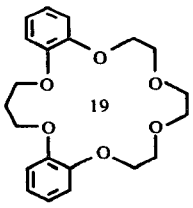

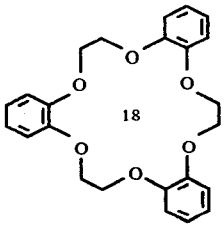

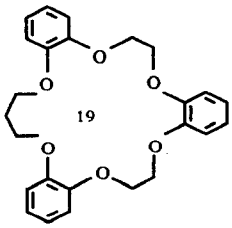

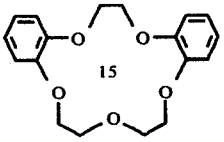

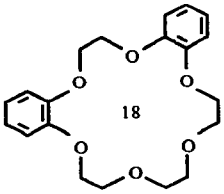

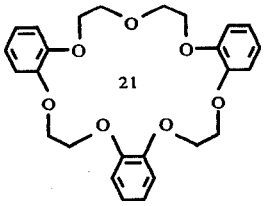

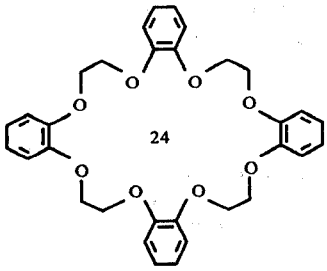

A typical developer composition of this invention comprises:

1. A developing agent, e.g. a p-dihydroxybenzene.
2. A sulfite buffer, e.g. a bisulfite-addition compound, of an aliphatic aldehyde or ketone, for example sodium formaldehyde bisulfite.
3. An antioxidant, e.g. alkali metal sulfites.
4. An alkaline agent, e.g., sodium carbonate.
5. Auxiliary solvents, e.g., ethylene glycol.
6. Caustic alkali, e.g. sodium hydroxide.
7. Restrainer, e.g. Potassium bromide.
8. Sequestering agents, e.g., trisodium salt of ethylene diamine tetraacetic acid.

Other adjuvants may also be incorporated in the developer composition, e.g., hardeners, other quinone type developing agents, buffering agents, surfactants, etc., as is customary in the art.

This invention will now be illustrated by the following examples wherein commercially available films were processed in conventional lithographic developers and compared with the same developers containing films processed in various amounts of the crown compounds to demonstrate improvement in dot quality and contrast.

EXAMPLE 1

A sufficient quantity of high-contrast photolithographic film strips from a conventional lithographic film comprising a gelatin-silver bromochloride emulsion having a halide ratio of approximately 70% chloride and 30% bromide and containing a polyoxyethylene compound and coated on polyethylene terephthalate film base were prepared for developer and sensitometry tests. The polyoxyethylene compound used has the general formula $HO(CH_2CH_2O)_nH$ and has an average molecular weight of about 4000 (Tradename - Carbowax 4000). The emulsion coatings were approximately the silver halide equivalent of 100.0 mg. of silver nitrate per square decimeter when dry.

A portion of the strips were used as controls and, after exposure in a negative IB sensitometer modified for lithographic exposures as is known in the art, were developed at 80° F. in a standard lithographic developer having the following working strength formula:

| | |
|---|---|
| Hydroquinone | 20.0 grams |
| Ethylene glycol | 70.0 grams |
| Sodium formaldehyde bisulfite | 42.5 grams |
| Sodium sulfite, anhydrous | 2.0 grams |
| Sodium metaborate | 6.0 grams |
| Sodium hydroxide | 4.5 grams |
| Sodium sulfite, anhydrous | 2.0 grams |
| Potassium bromide | 2.0 grams |

-continued

| | |
|---|---|
| Potassium carbonate | 16.6 grams |
| Sodium bicarbonate | 4.4 grams |
| Trisodium salt of ethylene tetracetic acid | 1.0 grams |
| Water to make | 1.0 liter |

Test strips were exposed and processed in the above developer to which had been added the crown compounds in the quantities as indicated in the following table which also shows the developing times and sensitometric data.

TABLE 1

| Compound Added | mg/L. of Developer | Minutes Development | Relative Speed | Average Gradient between dens. 1.0 and dens. 3.5 |
|---|---|---|---|---|
| Control | None | 1.5 | 600 | 13.0 |
| | | 2.0 | 715 | 8.0 |
| III | 50 | 1.5 | 290 | 15.0 |
| | 50 | 2.0 | 487 | 17.5 |
| I | 5 | 1.5 | 487 | 16.0 |
| | 5 | 2.0 | 740 | 13.4 |
| | 10 | 1.5 | 270 | 18.0 |
| | 10 | 2.0 | 396 | 23.5 |
| II | 5 | 1.5 | 504 | 13.4 |
| | 5 | 2.0 | 715 | 9.2 |
| | 10 | 1.5 | 440 | 14.0 |
| | 10 | 2.0 | 715 | 11.4 |
| | 20 | 1.5 | 411 | 16.0 |
| | 20 | 2.0 | 600 | 14.6 |

The above data indicates that although the compounds tend to reduce speed in some instances they show increased gradient when used in the correct concentration.

EXAMPLE 2

Example 1 was repeated wherein the crown Compound I was added to the standard developer with varying amounts of the developing agent duroquinone (tetramethyl-p-benzoquinone), used in addition to the 20 gms hydroquinone. The results are shown in the following table.

TABLE II

| Additions Per Liter Developer A | B | Minutes Devel. | Rel Speed | 1.0–3.5 Gradient |
|---|---|---|---|---|
| — | — | 1.5 | 666 | 10.8 |
| | | 2.0 | 740 | 7.1 |
| 5 mg | — | 1.5 | 715 | 11.2 |
| 5 mg | — | 2.0 | 821 | 6.4 |
| 10 mg | — | 1.5 | 766 | 10.2 |
| 10 mg | — | 2.0 | 850 | 6.1 |
| — | 10 mg | 1.5 | 321 | 16.8 |
| — | 10 mg | 2.0 | 455 | 22.7 |
| 10 mg | 10 mg | 1.5 | 383 | 22.7 |
| 10 mg | 10 mg | 2.0 | 504 | 21.8 |
| (10 mg + 10 mg)* | | 1.5 | 321 | 18.8 |

TABLE II-continued

| Additions Per Liter Developer | Minutes Devel. | Rel Speed | 1.0–3.5 Gradient |
|---|---|---|---|
| (10 mg + 10 mg) | 2.0 | 642 | 27.6 |

A = Duroquinone
B = Dibenzo-18-Crown-6, (Compound I)
* = A&B mixed together before adding to developer.

The addition of duroquinone with the crown compound increases the speed without loss of the increases in gradient over the control.

EXAMPLE 3

Example 1 was repeated using compound I in an amount of 10 mg./liter of developer. Instead of the sensitometric measurements as set forth in that example, an examination of the dot quality of different size dots was made using a measuring microscope. Using the subjective scale of 1 to 4 as described above, the following results were obtained.

TABLE III

| Additive | Development Time In Minutes | Dot Rating 10% | 50% | 90% |
|---|---|---|---|---|
| None (Control) | 1.5 | 4 | 3.3 | 4.0 |
| 10 mg Comp'd I | 1.5 | 2.0 | 1.0 | 2.3 |

Dot quality ratings are shown for dots ranging in size from 10 to 90% based on the area covered by developed silver using a conventional 133 lines per inch magenta halftone screen backed by a continuous wedge for exposure.

Considerably improved dot quality resulted from the addition of the crown compound to the developer.

EXAMPLE 4

Example 1 was repeated using compound I in an amount of 10 mg/liter of the developer, separately and in combination with two to four gram quantities of a linear polyethylene oxide compound having an average molecular weight of about 4000. The sensitometric data is shown in the following table.

TABLE IV

| Additives/liter of Developer Comp. I | Polyethylene Oxide | Develop. Time In Minutes | Rel. Speed | Gradient 1.0–3.5 |
|---|---|---|---|---|
| None-Con. | None-Control | 1.5 | 642 | 10.3 |
| None-Con. | None-Control | 2.0 | 715 | 7.0 |
| 10 mg. | 0 | 2.0 | 476 | 22.1 |
| 0 | 2 g | 2.0 | 792 | 6.7 |
| 10 mg. | 2 g | 2.0 | 621 | 18.0 |
| 10 mg. | 4 g | 2.0 | 621 | 21.6 |

The above data show how the linear polyethylene oxide restores the speed loss resulting from use of the crown compound while retaining the improvement in gradient.

EXAMPLE 5

Example 1 was repeated with varying quantities of Compound V added to the standard developers as indicated in the following table.

TABLE V

| Compound V Mg./liter of Developer | Develop. Time In Minutes | Relative Speed | Gradient 1.0–3.0 |
|---|---|---|---|
| None-(Control) | 1.5 | 690 | 10.5 |

TABLE V-continued

| Compound V Mg./liter of Developer | Develop. Time In Minutes | Relative Speed | Gradient 1.0–3.0 |
|---|---|---|---|
| | 2.0 | 766 | 7.5 |
| 1 | 1.5 | 642 | 12.8 |
| | 2.0 | 766 | 7.7 |
| 3 | 1.5 | 600 | 13.9 |
| | 2.0 | 740 | 8.8 |
| 5 | 1.5 | 558 | 15.0 |
| | 2.0 | 766 | 10.8 |

The data indicate that the crown compound, dibenzo-30-crown-10 is effective in increasing gradient although at the expense of a slight decrease in speed depending upon the development time.

EXAMPLE 6

Example 1 was repeated except that additional potassium bromide besides the two grams in the standard developer was used with 10 mg/liter of Compound I. The results are shown in the following table.

TABLE VI

| Compound I | Gram/L. KBr | Development Time 80° F | Relative Speed | Gradient 1.0–3.0 |
|---|---|---|---|---|
| Control 0 | 0 | 2.0 | 715 | 7.0 |
| 10 mg | 0 | 2.0 | 476 | 22.1 |
| 10 mg | 0.25 | 2.0 | 440 | 25.6 |
| 10 mg | 0.50 | 2.0 | 369 | 34.8 |

It is noted that the additional potassium bromide also reduced the speed, but acts with the crown compound to increase the gradient over that obtained using the crown compounds alone.

EXAMPLE 7

Example 1 was repeated using 10 mg/liter of Compound 1. In this example, the strips were developed in fresh developer and in the developer after aging in an open tank for 16 hours thus causing developer exhaustion due to aerial oxidation. The results are shown in the following table.

TABLE VII

| Compound I | Development Time at 80° F | Relative Speed | Gradient 1.0–3.0 |
|---|---|---|---|
| Control 0 | Fresh 1.5 | 642 | 11.4 |
| Control 0 | Aged 1.5 | 642 | 11.0 |
| 10 mg | Fresh 2.0 | 504 | 21.1 |
| 10 mg | Aged 2.0 | 487 | 21.9 |

The unexpectedly high gradient effect does not weaken with developer exhaustion.

We claim:

1. The process of developing a silver halide image with a photographic developer solution containing a silver halide photographic developing agent and a crown compound having 5–16 oxygen atoms in a cyclic ring having a total of 14–60 atoms.

2. The process of claim 1 wherein said developer solution is an aqueous alkaline photographic developer solution.

3. A process for the production of developed photographic material which comprises subjecting photographic lith material containing a latent silver image in a silver halide emulsion layer to development by means of a formaldehyde/bisulphite/hydroquinone lithographic developer, the process being characterized in that the development takes place in the presence of a crown compound having 5–16 oxygen atoms in a cyclic ring having a total of 14–60 atoms.

4. The process of claim 3 wherein the crown compound is employed in an amount of 1–100 mgs. per liter of developer.

5. The process of claim 3 wherein said crown compound is dibenzo-18-crown-6.

6. The process of claim 3 wherein said crown compound is dibenzo-30-crown-10.

7. An aqueous developer solution containing a silver halide photographic developing agent and a crown compound having 5–16 oxygen atoms in a cyclic ring having a total of 14–60 atoms.

8. A photographic developer capable of producing high contrast images upon photographic development comprising a developing solution containing a p-dihydroxybenzene developing agent, a sulfite buffer, and a crown compound having 5–16 oxygen atoms in a cyclic ring having a total of 14–60 atoms.

9. The developer of claim 8 wherein said crown compound is dibenzo-18-crown-6.

10. The developer of claim 8 wherein said crown compound is dibenzo-30-crown-10.

* * * * *

UNITED STATES PATENT OFFICE

CERTIFICATE OF CORRECTION

PATENT NO. : 4,017,314

DATED : April 12, 1977

INVENTOR(S) : Ralph Kingsley Blake

It is certified that error appears in the above-identified patent and that said Letters Patent are hereby corrected as shown below:

| Patent Column | Patent Line | Corrections |
|---|---|---|
| 2 | | Compound II, change "S=" (upper right of formula to -- S- --. |
| 5&6 | 2nd row, rt. formula | "25" should be -- 26 --. |
| 10 | 17 | "14-60" should be -- 15-48 --. |
| 10 | 22-23 | "photographic lith" should be -- photo-lithographic --. |
| 10 | 26-27 | cancel ", the process being characterized in that the development takes place in the presence of" and replace with -- containing --. |
| 10 | 29 | "14-60" should be -- 15-48 --. |
| 10 | 40 | "14-60" should be -- 15-48 --. |

UNITED STATES PATENT OFFICE

CERTIFICATE OF CORRECTION

Patent No. 4,017,314 Dated April 12, 1977

Inventor(s) Ralph Kingsley Blake

It is certified that error appears in the above-identified patent and that said Letters Patent are hereby corrected as shown below:

Column 10, line 46, "14-60" should read -- 15-48 --.

Signed and Sealed this twenty-third Day of August 1977

[SEAL]

Attest:

RUTH C. MASON
*Attesting Officer*

C. MARSHALL DANN
*Commissioner of Patents and Trademarks*